United States Patent [19]

Slodzian et al.

[11] Patent Number: 4,672,204

[45] Date of Patent: Jun. 9, 1987

[54] MASS SPECTROMETERS

[75] Inventors: Georges Slodzian, Sceaux; Marcel Chaintreau, Gometz le Chatel; Roger Dennebouy, Limours; Jean-Claude Lorin, Paris, all of France

[73] Assignee: Thomson-CSF, Paris, France

[21] Appl. No.: 849,348

[22] Filed: Apr. 7, 1986

Related U.S. Application Data

[63] Continuation of Ser. No. 600,359, Apr. 16, 1984.

[30] Foreign Application Priority Data

Apr. 19, 1983 [FR] France ..... 83 06375

[51] Int. Cl.[4] ..... H01J 44/30

[52] U.S. Cl. ..... 250/298; 250/295; 250/294; 250/296

[58] Field of Search ..... 250/298, 296, 295, 294, 250/281, 282

[56] References Cited

U.S. PATENT DOCUMENTS 3,231,735 1/1966 Peters ..... 250/296
3,866,042 2/1975 Vastel ..... 250/296

FOREIGN PATENT DOCUMENTS 2015813 4/1970 France .

OTHER PUBLICATIONS

Instruments and Experimental Techniques, No. 1, Jan.-Feb. 1968, New York (US) V. I. Karataev: "Chromatic Aberration in a Mass . . . ".

Instruments and Experimental Techniques, No. 3, May-Jun. 1962, New York (US) N. I. Ionov et al.: "Double Magnetic Mass Spectrometer . . . ".

The Review of Scientific Instruments, vol. 42, No. 4, Apr. 1971, New York (US) H. Balsiger et al.: "A Mass Spectrometer for the . . . ".

Space Science Instrumentation, vol. 2, No. 4, Sep. 1976, Boulder (US) H. Balsiger et al.: "A Satellite-born Ion Mass Spectrometer . . . ".

Journal of Mass Spectrometry and Ion Physics, vol. 8, No. 1, Jan. 1972, Amsterdam (NL) A. J. H. Boermoom.: "Ion Optics of the Electric . . . ".

*Primary Examiner*—Craig E. Church
*Assistant Examiner*—Jack I. Berman
*Attorney, Agent, or Firm*—Roland Plottel

[57] ABSTRACT

Mass spectrometer having an ion source, acceleration means able to impart to the ions an energy essentially dependent on their electric charge, means for producing in a sector a magnetic field orthogonal to the plane of the trajectory of the ions in order to inwardly curve said trajectory and means for detecting the ions. At the inlet of the magnetic sector are provided electrostatic means able to modify the tangential velocity of the ions and consequently their energy, in such a way that ions with different masses can, at different times, follow the same inwardly curved trajectory in the magnetic sector.

8 Claims, 4 Drawing Figures

MASS SPECTROMETERS

This application is a continuation of application Ser. No. 600,359, filed 4/16/84.

BACKGROUND OF THE INVENTION

1. Field of the invention

The present invention relates to a mass spectrometer incorporating an ion source, acceleration means able to impart to the ions an energy essentially dependent on their electric charge, means for establishing in a sector a magnetic field orthogonal to the plane of the trajectory of the ions in order to inwardly curve said trajectory as well as means for detecting the ions.

2. Description of the prior art

In order to carry out a precise measurement of the isotopic abundance ratios, it is possible to carry out a mass scan, which makes it possible to frequently pass from one isotope to the other or from one element to the other, if it is wished to obtain the precise value of a ratio. Such a mass scan would be superfluous if the spectrometer was provided with multiple outputs permitting the simultaneous connection of several ionic species on separate detectors. However, such multiple output spectrometers are generally designed for special applications, so that it is often far from easy, or even impossible, without structural transformations to change the nature of several initially provided elements. In addition, such multiple output spectrometers are expensive. Therefore, mass scanning is the most widely used solution and makes it possible to work at different times on different mass isotopes, with a sufficiently fast time scanning to attenuate the drift or migration of the ion source.

SUMMARY OF THE INVENTION

The object of the invention is more particularly to supply a mass spectrometer, in which mass scanning can be carried out in a precise and rapid manner.

According to the invention, a mass spectrometer of the type defined hereinbefore is characterized in that it comprises, at the inlet to the magnetic sector, electrostatic means able to modify the tangential velocity of the ions and consequently their energy, in such a way that ions of different masses can, at different times, follow the same inwardly curved trajectory in the magnetic sector.

Preferably, at the outlet from the magnetic sector, the spectrometer has electrostatic means able to cancel out the modification to the tangential velocity introduced by the electrostatic means located at the magnetic sector inlet. In other words, if an ion has undergone a positive tangential acceleration on entering the magnetic sector, it is decelerated on leaving it and therefore resumes its basic velocity. Conversely, if an ion has been decelerated at the inlet, it will be accelerated at the outlet.

Generally, after having been accelerated by the acceleration means and after having received a given energy, the ions describe their trajectory, in vacuo, in a metal enclosure raised to earth potential. The means able to modify the tangential velocity of the ions can comprise a metal envelope with a closed transverse contour, which is open at its two ends and whose mean line corresponds to the trajectory provided for the ions. The envelope is placed in the magnetic field and extends from the magnetic sector inlet to the outlet. It is raised to the same electrical potential as the transverse electrodes located at the envelope inlet and is able to produce a tangential acceleration or deceleration electrostatic field, essentially parallel to the direction of the velocity of the ions when they enter said envelope.

This insulated metal envelope placed in the electromagnetic field, i.e. between the poles of the electromagnet, makes it possible to maintain the poles of the magnet at earth, without this having any influence on the ions whose energy, modified at the entrance of the magnetic field, remains constant in the latter.

According to another possibility, the voltage for producing the tangential acceleration electrostatic field, at the inlet of the magnetic sector, could be directly applied to the poles of the magnet. The voltage for producing a positive or negative tangential acceleration at the magnetic sector inlet is approximately a few hundred volts so that the control of the variations of this voltage can take place more precisely and rapidly than for a much higher voltage. The voltage increments may only be 15 mV, which provides excellent precision of the pointing or monitoring of a line.

The invention is advantageously applied to double focusing of mass spectrometers.

BRIEF DESCRIPTION OF THE DRAWINGS

The invention is described in greater detail hereinafter relative to non-limitative embodiments and with reference to the attached drawings, wherein show.

DESCRIPTION OF THE PREFERRED EMBODIMENTS

Before describing the invention relative to the drawings, it is pointed out that the object of the invention is to permit the precise measurement of the isotopic abundance ratios using a mass spectrometer and particularly a mass spectrometer of the ion analyzer type, generally with double focusing. In an ion analyzer, the ions are produced by a secondary ionic emission phenomenon, i.e. a sample of the material to be analyzed is bombarded by ions, said bombardment leading to the ejection of ions which are characteristic of the material to be analyzed. The analysis carried out by the spectrometer relates to these ejected ions. The thus ejected ions have a relatively high energy dispersion at the exit from the target (formed by the material to be analyzed). This energy dispersion is well above that existing when the ions are emitted by a thermoionic effect.

Moreover, the secondary ionic emission phenomenon simultaneously produces polyatomic ions and single ions, which can have similar masses. For example, magnesium has three isotopes $^{24}Mg$, $^{25}Mg$, $^{26}Mg$. The vacuum and bombardment conditions or the very nature of the sample means that there are often ions of the $MgH^+$ type, which are superimposed on ions of the $Mg^+$ type. Thus, at mass number 25, there are ions $^{25}Mg^+$, $(^{24}MgH)^+$. The polyatomic atomic ions are generally much weaker, but their intensity can be sufficiently high to prejudice a precise measurement of the isotopic abundance ratios. In this example, a separative power (M/ΔM) of 3700 is sufficient to distinguish the two types of ion. Thus, it is generally necessary to use a double focusing spectrometer operating with high mass resolution in order to bring together in the same "line", ions of the same mass, no matter what the (small) angle with which they emerge from the source and no matter what the exact energy they have around the mean value to which they have nominally been accelerated.

The drift or migration of the ion source makes it necessary to carry out a mass scan, which makes it possible to frequently pass from one isotope to the other, or from one element to the other, if it is wished to obtain the precise value of the ratio.

The object of the invention is to improve this mass scan.

Figure 1:
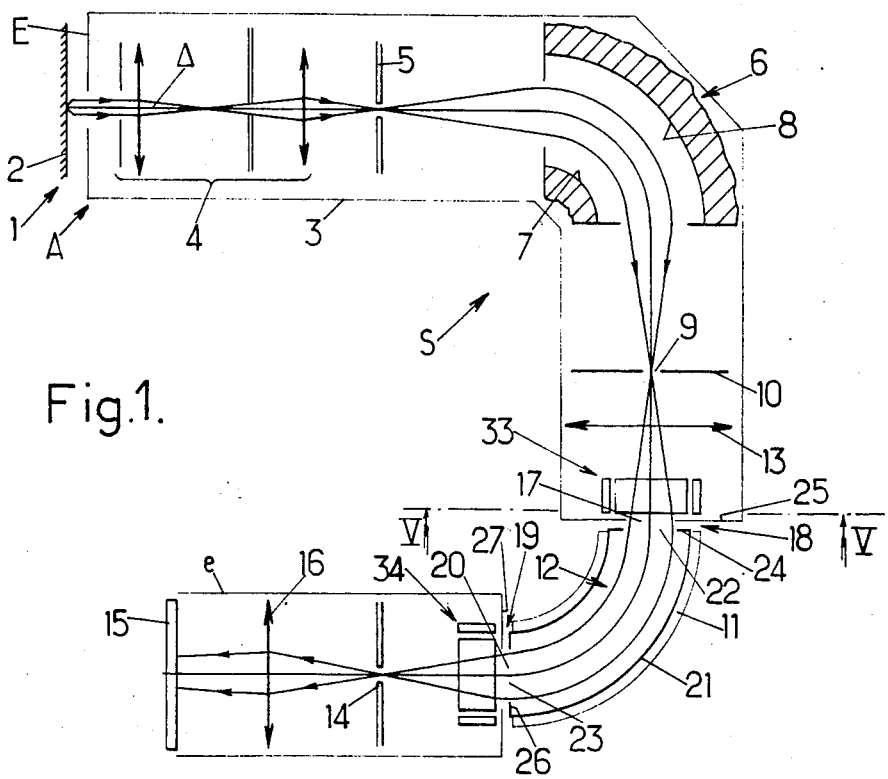
FIG. 1 a diagram of a double focussing mass spectrometer according to the invention in plan view.

In FIG. 1, it is possible to see the diagram of a double focusing mass spectrometer S used as an ion analyzer. This spectrometer has an ion source 1 operating according to the secondary ionic emission phenomenon principle. This source 1 comprises a target 2, formed by a sample of the material to be analyzed and which is bombarded by ions coming from a not shown source. The complete mass spectrometer is located in a not shown, tight enclosure, in which an adequate vacuum has been produced.

Acceleration means A are able to impart to the ions ejected from target 2, an energy which is essentially dependent on their electric charge. These means A comprise an electrode E, located in a plane perpendicular to the direction Δ of the movement of the ions. With respect to target 2, electrode E is raised to a potential imparting the desired energy to the ions. The electrostatic acceleration field between electrode E and target 2 is parallel to the trajectory of the ions. Electrode E can be raised to earth potential, in which case target 2 is raised to a positive potential if it is wished to accelerate positive ions, or to a negative potential in the case of negative ions. The acceleration potential is approximately 4000 V. Following acceleration, the ions circulate in a tubular metal enclosure 3, raised to the same potential as electrode E and serving as a protective means.

The ion beam passes through a first electrostatic optical system 4 and then through an inlet diaphragm 5. It then enters an electrostatic sector B between two inwardly curved, concentric walls 7, 8, raised to different potentials, so that the electrostatic field in sector 6 is radially oriented. This electrostatic sector produces a first focusing of the ions at opening 9 of a second diaphragm 10. The direction of the ion trajectory at the outlet from electrostatic sector 6 has turned by a certain angle compared with its inlet direction, said angle being 90° in the example of FIG. 1.

Means formed by an electromagnet, whose one pole 11 is diagrammatically shown, are provided for establishing in a magnetic sector 12 a magnetic field orthogonal to the plane of the trajectory of the ions, i.e. orthogonal to the plane of FIG. 1 and able to inwardly curve the trajectory of the ions. An electrostatic coupling lens 13 is provided between the electrostatic static sector 6 and magnetic sector 12. Selection slots 14 are provided in the focusing area produeed by magnetic sector 12. The ion detection means comprise a detection system 15 located downstream of a collector lens 16.

With such an apparatus, when the magnetic field in sector 12 is regulated so as to exactly address isotopes having a given mass in the centre of selection slot 14, the other isotopes with the same electrical charge but with different masses will turn, in sector 12, in accordance with different radii. The isotopes with a mass below M will turn in accordance with a smaller radius, whilst the isotopes with a mass greater than M will turn with a larger radius than that associated with the isotope of mass M.

According to the invention, at the inlet 17 of magnetic sector 12, the spectrometer has electrostatic means 18 able to modify the tangential velocity of the ions and consequently their energy, so that ions with different masses can, at different times, follow the same inwardly curved trajectory in magnetic sector 12.

For example, in the case of magnesium, it will be assumed that the fixed magnetic field in sector 12 is regulated in such a way as to address isotope 25 in the centre of slot 14. If it is wished to address isotope $^{24}Mg$, instead of isotope $^{25}Mg$ in the centre of slot 14, according to the invention and without modifying the magnetic field, the ions at their entrance 17 in sector 12 will be positively accelerated in the direction of their trajectory, so that isotope $^{24}Mg$ can turn in accordance with the same trajectory as that previously followed by isotope $^{25}Mg$.

If it is wished to address isotope $^{26}Mg$ in the centre of slot 14, the ions undergo a negative acceleration at entrance 17, i.e. a deceleration in the direction of their trajectory, so that isotope $^{26}Mg$ follows the same trajectory as that previously followed by isotope $^{25}Mg$.

Electrostatic means 19 are provided at the outlet 20 of sector 12, in order to cancel out the energy modification introduced by means 18. In other words, means 18 have positively accelerated ions at the entrance or inlet, means 19 will exercise a deceleration action to return these ions to their initial energy, and conversely if means 18 have exercised a decelerating action, means 19 will bring about an acceleration.

Figure 4:
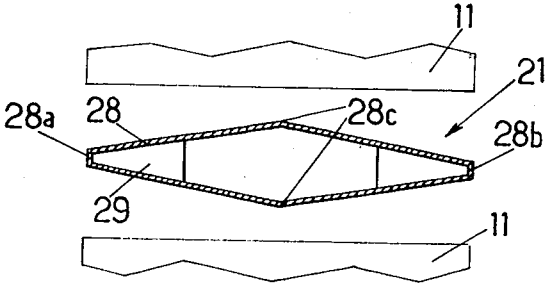
FIG. 4 a section along line IV—IV, of FIG. 3.

Means 18 incorporate a metal envelope 21, particularly made from gold-coated copper, with a closed transverse contour (cf. FIG. 4)., which is open at its two ends 22, 23 and whose mean line corresponds to the trajectory provided for the ions in sector 12. Envelope 21 is placed in the magnetic field and extends from the inlet 17 to the outlet 20 of sector 12. Envelope 21 is raised to the same electric potential as the electrodes or the transverse metal plates 24 connected to said envelope and located at the inlet 17 of sector 12. Plates 24 face transverse plates 25 at the end of tubular enclosure 3 and plates 25 are raised to the same potential as the latter, i.e. to earth potential or potential O. Plates 24, 25 are located in planes orthogonal to the mean direction of the trajectory of the ions at said plates, and form electrodes, whose axis is aligned on that of the ion beam. The electric field between these plates is oriented parallel to the axis of the beam.

Means 19 incorporate other transverse plates or electrodes 26, located at the end 23 of the envelope. Plates 26 are at the same potential as envelope 21 and plates 24. Plates 27, at earth potential, are positioned facing plates 26, the planes of these plates being perpendicular to the axis of the ion beam leaving sector 12. The electric field produced between plates 26 and 27 produces an opposite effect, but of the same amplitude, to that produced by plates 24, 25.

Plates 27 are joined to a tubular metal screen e, which is at the same potential as plates 27 and which extends up to the detection system.

Metal envelope 21 protects the electrically charged ions, in magnetic sector 12, against external, parasitic, electrostatic influences. Thus, the poles such as 11 of the electromagnet can be at earth potential without suffering any disadvantage.

According to another, somewhat less advantageous solution, poles such as 11 of the electromagnet could be raised to the potential of plates 24 and 26, in which case metal envelope 21 would be rendered superfluous.

In order to reduce the formation of stray capacitances between envelope 21 and the electromagnet poles 11, the cross-section 28 (FIG. 4) of said envelope is given a flattened shape and is essentially in the form of a lozenge, whose major axis is located in the median plane of the field of the air gap, whilst the minor axis is halfway across the air gap. The lateral edges 28*a*, 28*b* of the envelope, which are radially spaced from the interesting trajectory, are further from the electromagnetic poles than the central part 28*c* of envelope 21. Thus, there is a reduction in the stray capacitance, which limits the switching time of the voltages applied to envelope 21.

The wall of said envelope 21 advantageously has ridges 29 (FIG. 3), so that baffles are formed within envelope 21 for stopping the ions, whose masses differ from that to which more particular interest is attached.

Figure 3:
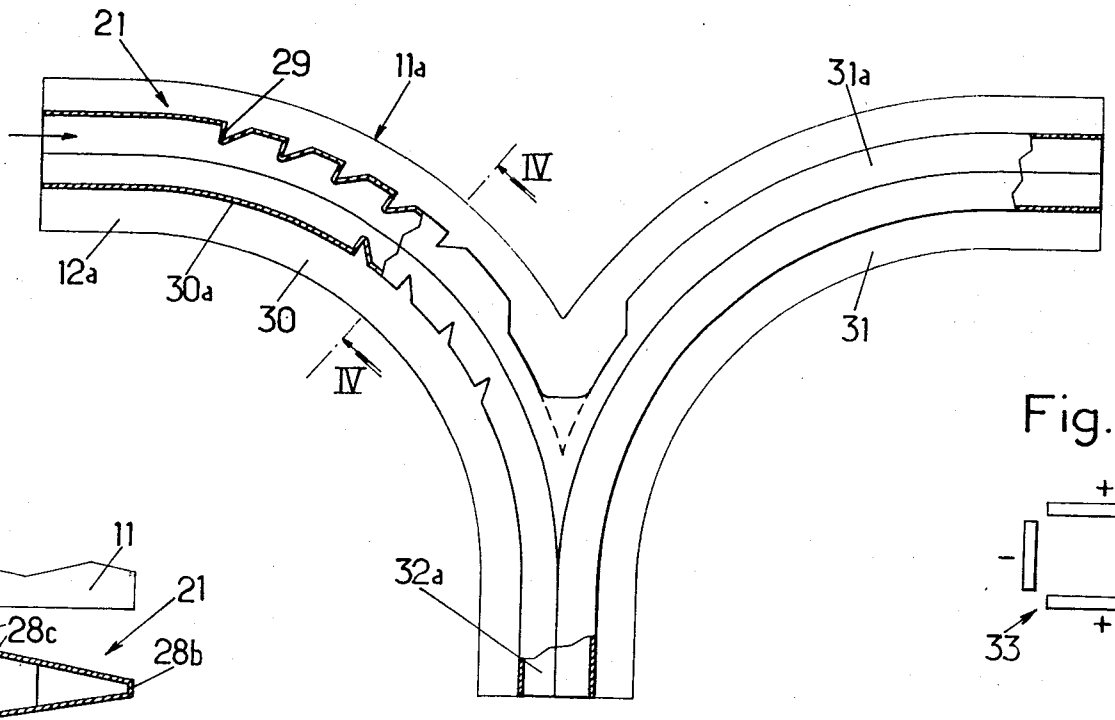
FIG. 3 a plan view of a metal envelope to be placed in the magnetic sector and belonging to the means able to modify the tangential velocity of the ions.

According to a variant shown in FIG. 3, the magnetic poles 11*a* and the magnetic sector 12*a* can be substantially Y-shaped, this shape being constituted by two circular arcs 30, 31, having their convexity directed towards one another and which are tangential at one end reciprocally symmetrical with respect to the tangent. One of the branches, formed by the left-hand arc 30 in FIG. 3, is used for the actual mass spectrometer, whilst the other branch 31 is used for a display means combined with the mass spectrometer. In this case, envelope 21 is preferably shaped like magnetic sector 12*a* and has two circular arc-like branches 30*a*, 31*a*, which are connected at the common end 32*a*. Only branch 30*a* used in the part of the spectrometer acting as an ion analyzer has ridges 20. The presence of branch 31*a* makes it possible to prevent parasitic phenomena particularly distortions on the image observed in this part of the apparatus.

Plates 24, 25 on the one hand and plates 20, 27 on the other are given a shape leading to the prevention or at least to a reduction of the parasitic effects and particularly the focusing effects which could possibly be introduced by the electrostatic means.

Figure 5:
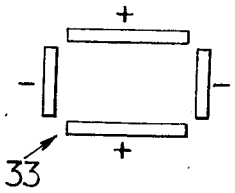
FIG. 5 a view of a quadrupole along line V—V of FIG. 1.

The optical properties of the acceleration and deceleration spaces (at means 18 and 19) can be taken into consideration, together with their harmful effects of the double focusing. Small "multipoles" and in particular "quadrupoles" 33, 34, appropriately placed at the outlet of the magnetic sector make it possible to correct these parasitic effects. Voltages of a few volts are sufficient, so that there is no difficulty in programming the almost simultaneous application of the voltage to envelope 21 and of voltages to quadrupoles 33, 34. Quadrupole 33 is formed by four rectangular metal plates arranged in accordance with the faces of a rectangular parallelepiped (cf. FIG. 5). The pairwise facing plates are raised to the same potential so that adjacent plates in orthogonal planes are at different potentials.

As a result of the invention, it is possible in a few milliseconds to pass from one isotope to the other and to retain substantially equally fine lines, located precisely in the centre of the selection slot 14. The fundamental relation between the atomic masses $M_1$, $M_2$, $M_3$, etc. of the considered elements and the potential differences $V_1$, $V_2$, $V_3$, etc. for the acceleration of the ions during their passage in the magnetic field is as follows:

$$M_1V_1=M_2V_2=M_3v_3$$

If $V_0$ is the nominal value of the acceleration potential difference at the level of source 1 and $v_1$, $v_2$, $v_3$ are the additional voltages applied to envelope 21, we obtain:

$$M_1(V_0+v_1)=M_2(V_0+v_2)=M_3(V_0+v_3)=$$

No difficulties are encountered in carrying out measurements in a mass variation range $\Delta M$, such that $\Delta M/M$ is substantially equal to $\pm 1/10$. In the case of $V_0$ of approximately 4000 V, it is sufficient to vary the additional voltage by $\pm 400$ V. Thus, all the isotopic ratios are accessible starting from lithium (and including lithium).

A number of other important points should be noted. It is not necessary for the fixed value of the magnetic field to be accurately regulated to ensure that a particular isotope passes in the centre of slots 14. This regulation or setting can be carried out directly by means of the voltage "v" applied to the metal envelope 21. The pointing or monitoring accuracy of the line greatly exceeds the mass resolution, so that $\Delta M/M$ of $10^{-5}$ can be detected. This precision can be used for accurately determining the nature of a polyatomic ion. It can also be used for addressing the lines in the centre of the selection slot 14. It is then possible to give the latter the optimum width compatible with the elimination of the interfering ion and with a precise measurement of the intensity of the line, because the risks of interruption by the lips of the slot are then minimized.

Finally, if the measurement of the intensities subsequently takes place by counting with a multiplier (which would appear to be inevitable in view of the switching frequency), it is necessary to ensure that the switched beams always strike the same point of the dynode at which the ion—electron conversion takes place. If this were not the case, it would be necessary to install correctors excited or synchronized with the switching.

Figure 2:
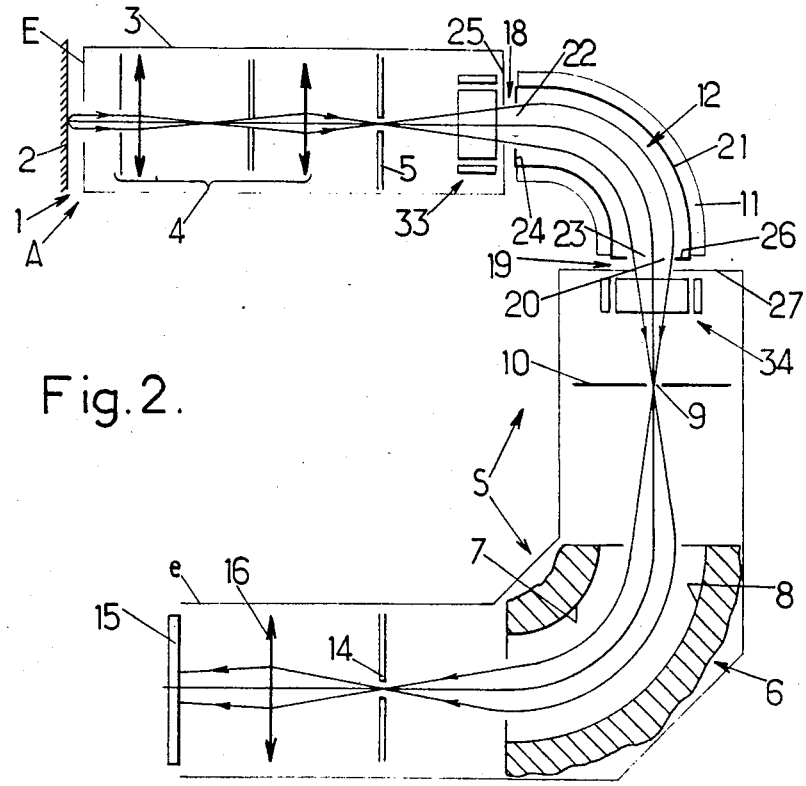
FIG. 2 a diagram of a variant of the spectrometer of FIG. 1.

FIG. 2 shows a variant in which the magnetic sector 12 is positioned upstream of the electrostatic sector 6. The same numerical references as in FIG. 1 are used in FIG. 2 for designating identical or similar elements.

What is claimed is:

1. A mass spectrometer with mass scanning means for obtaining a precise measurement of the isotope abundance ratios comprising:

a ion source acceleration electrode able to impart to the ions an energy which is essentially dependent an the electric charge thereof focusing means for focusing of the ions at opening of a diaphragm ion detector means a only one magnetic sector located between diaphram and detection means and coupled to means for producing a magnetic field orthogonal to the plane of the trajectory of the ions to inwardly curve said trajectory first electrostatic means controlled by an external source voltage for modifying by increments the energy of the ions at the inlet of the magnetic sector and the tangential velocity of the ions, in such a way that ions with different masses can, at different times, follow the same inwardly curved trajectory in the magnetic sector second electrostatic means located at the outlet of the magnetic sector and controlled by the same external source for canceling out the modification of the energy modification induced by first electrostatic means selection slot located in the focusing area of the magnetic sector between ion detector means and magnetic sector and multiples located at the magnetic sector inlet and or outlet for correcting the parasitic effects of the acceleration and deceleration spaces, said multipoles being controled in synchronism with first and second electrostatic means for refocusing the ions in the center of the selection slot.

2. A mass spectrometer according to claim 1 where in the ions circulate from the ion source to the inlet of the magnetic sector in a first metal enclosure and from the outlet of the magnetic sector to the ion detector means in a second metal enclosure, said first and second metal enclosure being raised to the same potential as acceleration electrode and being separated by a third metal enclosure placed in the magnetic field and extending from the inlet to the outlet of the magnetic sector, said third metal enclosure being raised to a potential different of the acceleration electrode potential to modify the tangential velocity of the ions circulating inside the magnetic sector.

3. A mass spectrometer according to claim 2 where in said extremities of the third metal enclosure have transverse plates which are facing transverse plates mounted at the extremities of first and second metal enclosure.

4. A mass spectrometer according to claim 3 wherein the cross-section of the third metal enclosure has a flattened shape and substantially in the form of a lozenge, whose major axis is located in the median plane of the field of the air gap of the magnetic sector whilst the minor axis is located halfway across the air gap.

5. A mass spectrometer according to claim 3, wherein the third metal enclosure has ridges in its wall, so that a baffle is formed within said envelope to stop the ions having masses different from that to which significance is attached.

6. A mass spectrometer according to claim 3 in which the magnetic sector is essentially shaped like a Y, constituted by two circular arcs which turn their convexity toward one another, wherein the envelope has a shape similar to that of the magnetic sector and has two circular arc-like branches, which are connected at the common end.

7. A mass spectrometer according to claim 1 wherein the electrostatic means for modifying the tangential velocity of the ions are supplied by a voltage directly applied to the poles of the electromagnet of the magnetic sector and serving to produce a tangential acceleration electrostatic field.

8. A spectrometer according to claim 1 wherein electrostatic means able to modify the tangential velocity of ions at the magnetic sector inlet are supplied by a voltage of a few hundred volts, the voltage increments possibly only being 15 mV.

* * * * *